US007165333B1

(12) United States Patent
Abdulkader

(10) Patent No.: US 7,165,333 B1
(45) Date of Patent: Jan. 23, 2007

(54) TEMPLATE AND METHOD OF FABRICATING RAFTERS

(76) Inventor: Jawad Abdulkader, 5823 Goldsboro Rd., Bethesda, MD (US) 20817

( * ) Notice: Subject to any disclaimer, the term of this patent is extended or adjusted under 35 U.S.C. 154(b) by 0 days.

(21) Appl. No.: 11/240,416

(22) Filed: Oct. 3, 2005

(51) Int. Cl.
*B43L 7/10* (2006.01)

(52) U.S. Cl. ..... 33/417; 33/423

(58) Field of Classification Search ..... 33/417, 33/403, 404, 406, 407, 415, 416, 418, 419, 33/423, 424, 425, 452, 456, 459, 460, 461, 33/462, 464
See application file for complete search history.

(56) References Cited

U.S. PATENT DOCUMENTS 2,744,332 A * 5/1956 Day ..... 33/416
3,991,474 A * 11/1976 Rath ..... 33/462
5,758,428 A * 6/1998 Kotlinski ..... 33/416
6,694,633 B1 * 2/2004 Nyquist ..... 33/417

* cited by examiner

*Primary Examiner*—Christopher W. Fulton
(74) *Attorney, Agent, or Firm*—Patton Boggs LLP

(57) ABSTRACT

A template and method for fabricating rafters. The template including a U-shaped component including a first arm with a slot, a second arm with a slot, and a base perpendicular to and connecting the first and second arms. The template also including an adjustable main arm slidably connected to the first and second arms of the U-shaped component, a seat rotatably connected to the base arm of the U-shaped component, and a ridge arm rotatably connected to a first end of the main arm. The template also includes a fascia arm rotatably connected to a second end of the main arm, and a soffit arm slidably connected to the fascia arm.

15 Claims, 5 Drawing Sheets

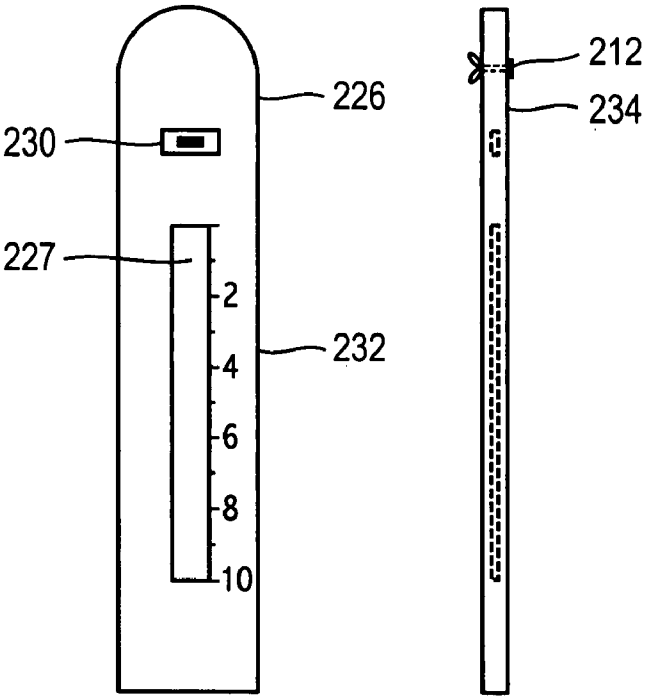
FIG. 8b
FIG. 8a
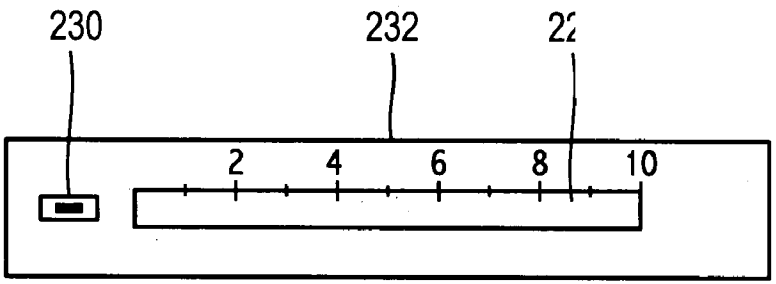
FIG. 7a
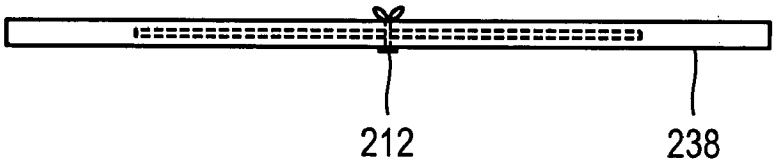
FIG. 7b

TEMPLATE AND METHOD OF FABRICATING RAFTERS

BACKGROUND

1. Field of the Invention

The invention is generally directed to tools and methods for constructing roofs and specifically to a method and template for fabricating rafters.

2. Description of the Related Art

The common rafter is cut at an angle at its uppermost end so that the rafter, when installed, provides the proper pitch to the roof while making a flush attachment to the ridge beam. The uppermost cut is known as the common ridge cut. The lower most end of the rafter is typically cut at an angle parallel to the common ridge cut so that the lowermost end of the rafter is perpendicular to the ground and parallel to the vertical walls of the structure being roofed. This lowermost cut is known as the tail end cut or fascia. In addition to these cuts, it is desirable to make a cut between the common ridge cut and the tail end cut such that rafter provides a parallel surface to set upon the vertical walls of the structure being roofed. This cut is often referred to as the bird's mouth or seat cut. This cut permits a maximum load bearing surface of the roof rafter to sit upon the top of the vertical wall.

For the roof to lie properly, all the rafters in the roof must be cut to the proper length, with the correct angles, and have an accurately placed bird's mouth or seat cut. Because it is difficult to make all the rafters for a given roof accurately, a skilled craftsman is typically required. Further, even a skilled craftsman requires a significant amount of time and effort to ensure all of the rafters are properly measured and marked before cutting. Therefore, it would be advantageous to have a device and method for fabricating rafters that is simple to use and can rapidly and accurately lay out rafters even when used by a relatively unskilled worker or an average construction worker.

SUMMARY OF THE INVENTION

One embodiment of the present invention provides a template for measuring a rafter of a roof comprising a U-shaped component including a first arm with a slot, a second arm with a slot, and a base perpendicular to and connecting the first and second arms; an adjustable main arm slidably connected to the first and second arms of the U-shaped component; a seat rotatably connected to the base arm of the U-shaped component; a ridge arm rotatably connected to a first end of the main arm; a fascia arm rotatably connected to a second end of the main arm; and a soffit arm slidably connected to the fascia arm.

In one aspect of the invention, the main arm comprises a plurality of extensions. In another aspect of the invention, the plurality of extensions are slidably adjustable. In another aspect of the invention, the seat is adapted to rest on a structural wall of a building and to be a template for a bird's mouth cut in the rafter. In another aspect of the invention, the fascia arm delineates the tail end cut of the rafter. In another aspect of the invention, the soffit arm delineates the soffit cut of the rafter. In another aspect of the invention, the ridge arm delineates the ridge cut of the rafter. In another aspect of the invention, the template further comprises a level in the ridge arm, the fascia arm, the soffit arm or any combination of arms thereof. In another aspect of the invention, the template further comprises locking mechanisms to keep the arms of the template in place. In another aspect of the invention, the template, further comprises a linear scale on the main arm, the main extensions, the first arm of the U-shaped component, the second arm of the U-shaped component, the fascia arm, the soffit arm, or any combination thereof. In another aspect of the invention, the template, further comprises an angular scale on the base of the U-shaped component, the fascia arm, the ridge arm or any combination thereof.

The present invention also provides a method of using a template to make a rafter for a roof comprising providing a template, the template including a U-shaped component including, a first arm with a slot, a second arm with a slot, and a base arm perpendicular to and connecting the first and second arms; an adjustable main arm slidably connected to the first and second arms of the U shaped component; a seat rotatably connected to the base arm of the U-shaped component; a ridge arm rotatably connected to a first end of the main arm; a fascia arm rotatably connected to a second end of the main arm; and a soffit arm slidably connected to the fascia arm; placing the seat of the template on a wall of the building; placing the ridge arm of the template against the ridge beam of a structure by adjusting the length of the adjustable main arm of the template; adjusting the template to establish the width of the rafter by sliding the main arm in the U-shaped component; setting the tail end of the rafter by adjusting the fascia arm of the template; and setting the soffit of the rafter by adjusting the soffit arm of the template.

In another aspect of the invention, the method further comprises locking the arms of the template in place. In another aspect of the invention, the method, further comprises leveling the template by consulting at least one level in the ridge arm, the fascia arm, the soffit arm or any combination of arms thereof. In another aspect of the invention, the method, further comprises using the seat to determine a bird's mouth cut.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings:

FIG. 7*a* is a side view of a soffit arm of the portion of the template illustrated in FIG. 6.

FIG. 7*b* is an edge view of the soffit arm illustrated in FIG. 7*a*.

FIG. 8*a* is a side view of a fascia arm of the portion of the template illustrated in FIG. 6.

FIG. 8*b* is an edge view of the fascia arm illustrated in FIG. 8*a*.

DETAILED DESCRIPTION OF THE EMBODIMENTS

The present invention allows an unskilled worker or an average construction worker to rapidly and accurately lay out rafters using the inventive tool and method. To this end, the present invention includes a template that is easy to use, yet is capable of accurately delineating the angles and cuts of a rafter. Once the adjustable features of the template are positioned and set, the user can repeatedly and reliably layout rafter after rafter having the correct length, angles, and placement of bird's mouth.

Figure 2:
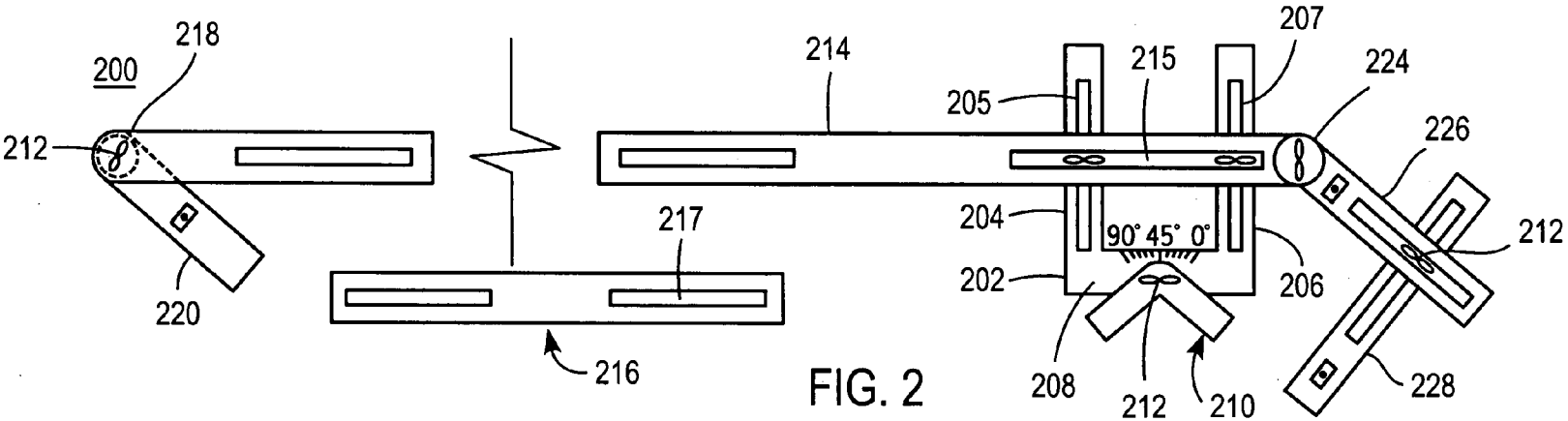
FIG. 2 is a side view of a template according to an embodiment of the invention.
Figure 1:
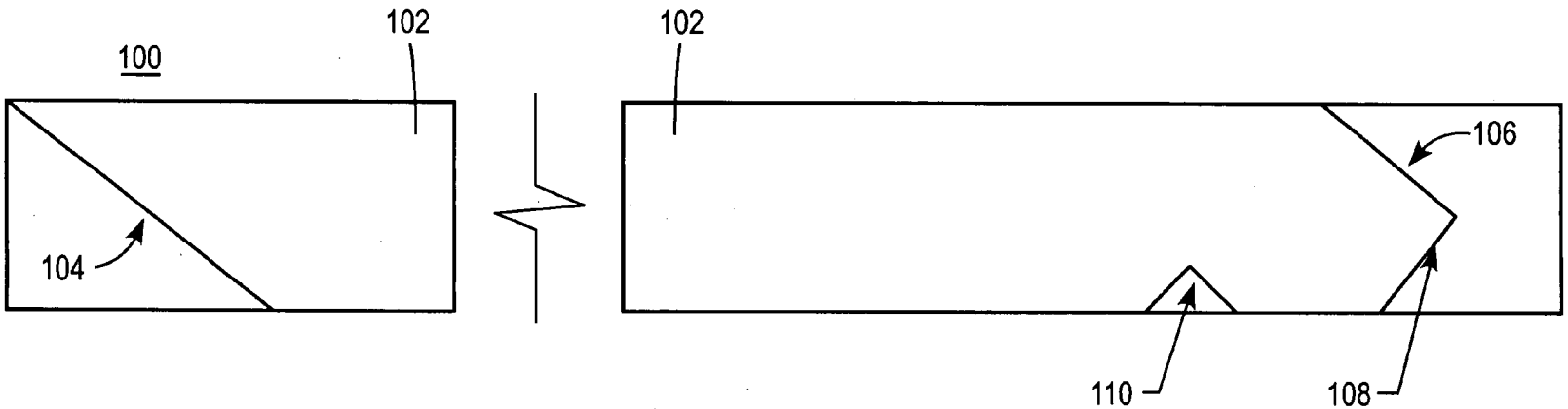
FIG. 1 is a side view of a rafter made with an embodiment of the invention.

FIG. 1 illustrates the outline of a rafter 102 marked on a board 100 with use of a template according to an embodiment of the invention. The board 100 may be a 2×6, 2×8, 2×10, 2×12, or any other suitable size for making rafters. As seen in FIG. 1, the rafter 102 includes a common ridge cut 104, a tail end cut or fascia 106, and the bird's mouth cut 110. The rafter also includes a soffit 108. When the rafter is cut and in placed on the structure being roofed, the soffit 108 is the bottommost portion of the rafter 102, while the tail end cut or fascia 106 is the outermost portion of the rafter 102. Typically, the soffit 108 is parallel to the ground while the tail end cut or fascia 106 is perpendicular to the ground.

FIGS. 2–8 illustrate a template 200 according to one embodiment of the invention. This embodiment includes a generally U-shaped component 202 that includes a first arm 204 and a second arm 206 connected to a base 208. Preferably, the first and second arms 204, 206 each include a longitudinally oriented slot 205, 207. Additionally, it is preferable that the base 208 is substantially perpendicular to the first and second arms 204, 206.

This embodiment of the invention also includes a seat 210. Preferably, the seat 210 is adapted to sit on the frame of a vertical wall of a structure being roofed. Additionally, it is preferable that the seat 210 is rotatably connected to the base 208 of the U-shaped component 202. More preferably, the seat 210 is rotatably connected with a connecting mechanism 212 that allows the seat 210 to be locked in a particular angular position after being rotated. In one preferred embodiment of the invention, the connecting mechanism 212 comprises a screw and a wing nut. Alternatively, the connecting mechanism 212 may comprise a nut and bolt or a butterfly screw. Optionally, the connecting mechanism 212 may include one or more washers. Other suitable connecting mechanisms 212 are known in the mechanical arts and may be used.

Figure 4A:
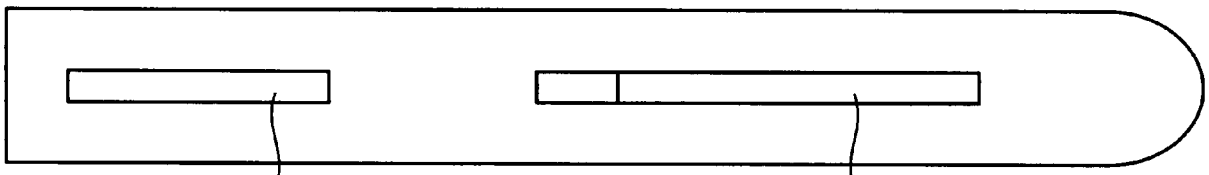
FIG. 4*a* is a close up of a portion of the main arm of the template illustrated in FIG. 2.
Figure 4B:
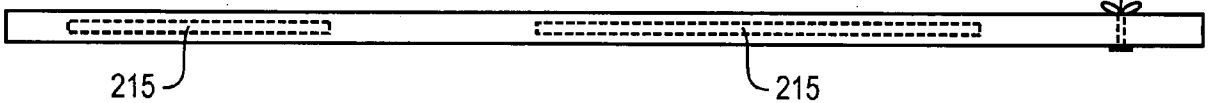
FIG. 4*b* is an edge view of the portion of the main arm illustrated in FIG. 4*a*.
Figure 5:
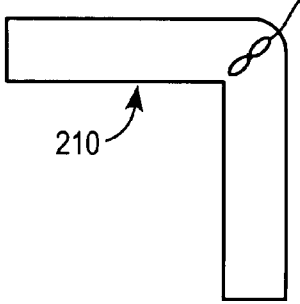
FIG. 5 is a side view of a seat of the template illustrated in FIG. 2.
Figure 3B:
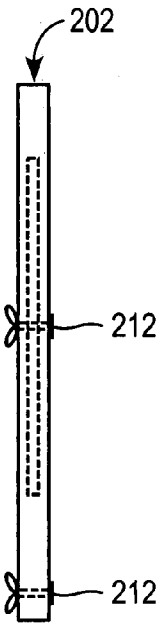
FIG. 3*b* is an edge view of the component illustrated in FIG. 3*a*.
Figure 3A:
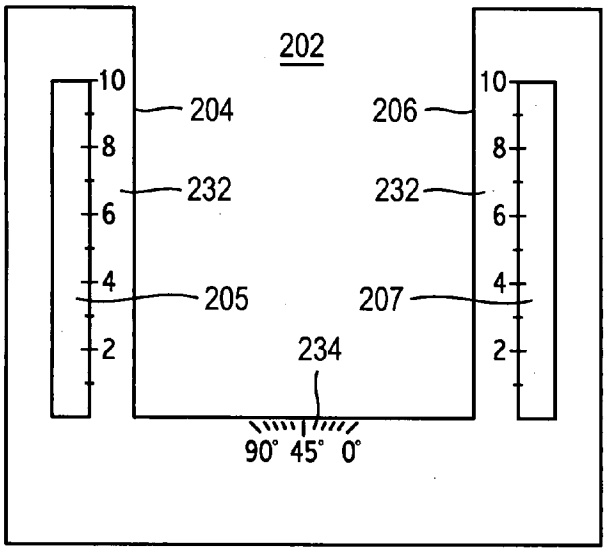
FIG. 3*a* is a close up of a component of the template illustrated in FIG. 2.
Figure 6:
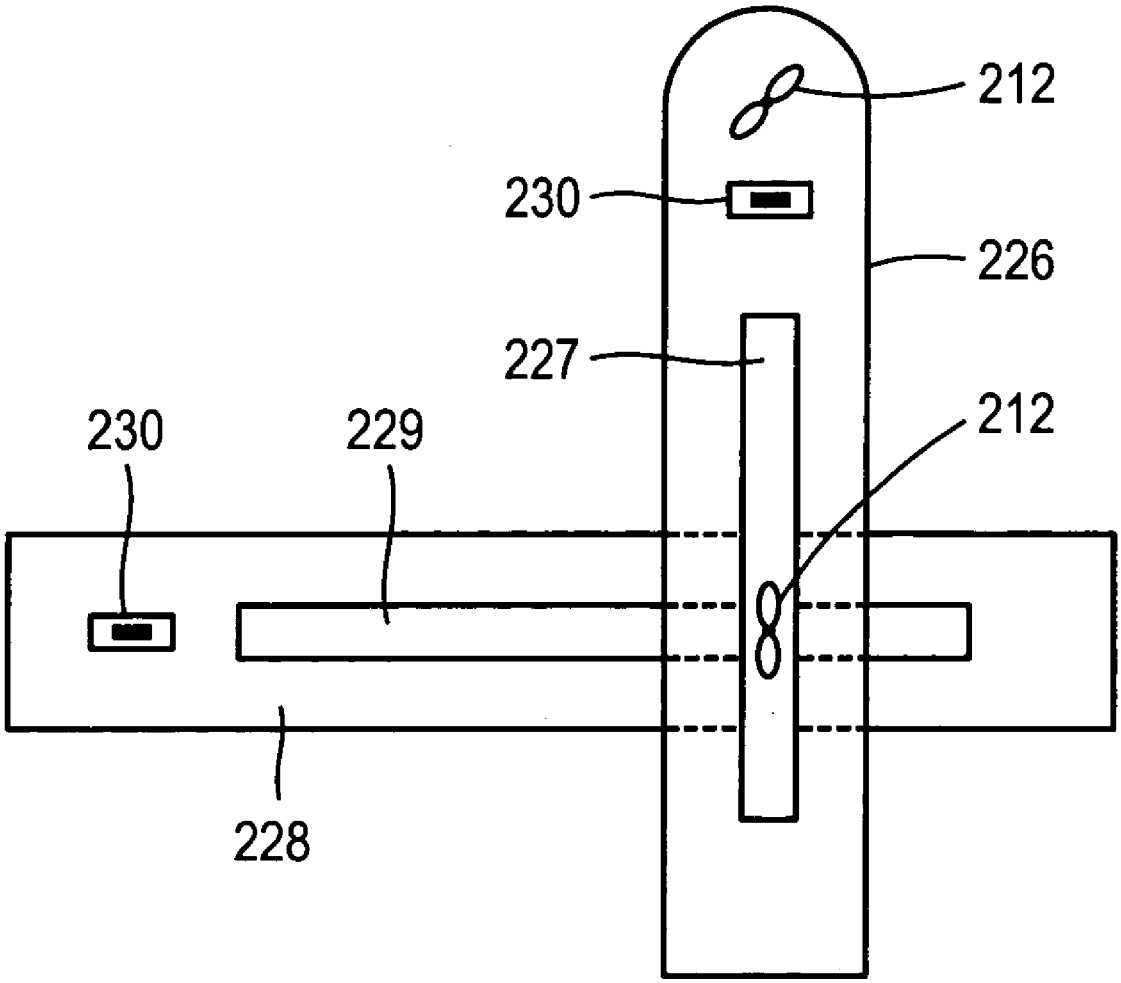
FIG. 6 is a close up of the fascia and soffit portion of the template illustrated in FIG. 2.

Referring to FIGS. 4*a* and 4*b*, the template 200 also preferably includes an adjustable main arm 214 slidably connected to the first and second arms 204, 206 of the U-shaped component 202. Preferably, the main arm 214 includes a longitudinally oriented slot 215 that is substantially perpendicular to the longitudinally oriented slots 205, 207 in the first and second arms 204, 206 of the U-shaped component 202. With this arrangement, the main arm 214 can be slidably adjusted in a direction perpendicular to the base 208 of the U-shaped component 202 and in a direction parallel to the base 208 of the U-shaped component 202. Preferably, the main arm 214 is slidably connected to the first and second arms 204, 206 with a connecting mechanism 212 that allows the main arm 214 to be locked in a particular position after being slidably adjusted. As discussed above, the connecting mechanism 212 may comprises a screw and a wing nut, a nut and bolt, a butterfly screw, or any other suitable connecting mechanism known in the mechanical arts.

In one embodiment of the invention, the main arm 214 may be lengthened by adding one or more slidable extensions 216. Preferably, the slidable extensions 216 include at least one longitudinal slot 217. More preferably, the slidable extensions 216 are slidably connected with a connecting mechanisms 212 that allow the main arm 214 to be locked at a particular length after being slidably adjusted.

The template 200 also preferably includes a ridge arm 220 (FIG. 1) rotatably connected to a first end 218 of the main arm 214. Preferably, the ridge arm 220 is rotatably connected with a connecting mechanism 212 that allows the ridge arm 220 to be locked in a particular angular position after being rotated. The template 200 also preferably includes a fascia arm 226 (FIGS. 6, 8*a* and 8*b*) rotatably connected to a second end 224 of the main arm 214. More preferably, fascia arm 226 is rotatably connected to the second end 224 of the main arm 214 with a connecting mechanism 212 that allows the fascia arm 226 to be locked in a particular angular position after being rotated. Preferably, the fascia arm 226 also includes a longitudinal slot 227.

Additionally, the template 200 preferably includes a soffit arm 228 (FIGS. 6, 7*a*, and 7*b*) slidably and rotatably connected to the fascia arm 226. Preferably the soffit arm 228 has a longitudinal slot 229 and is connected to the fascia arm 226 via the longitudinal slot 227 in the fasica arm 226. More preferably, the soffit arm 228 is slidably and rotatably connected to the fascia arm 228 with a connecting mechanism 212 that allows the soffit arm 228 to be locked in a particular position after being rotated and slidably adjusted.

In one preferred embodiment of the invention, at least one of the ridge arm 220, the fascia arm 226 or the soffit arm 228 includes a level 230 to aid in the adjustment of the arms 220, 226, 228. More preferably, at least two of the ridge arm 220, the fascia arm 226 or the soffit arm 228 includes a level 230. Even more preferably, each one of the ridge arm 220, the fascia arm 226 and the soffit arm 228 includes a level 230.

In still another preferred embodiment of the invention, various pieces of the template 200 may include a linear scale 232. For example, the first arm 204 of the U-shaped component 202, the second arm 206 of the U-shaped component 202, or both the first arm 204 and the second arm 206 may include a linear scale 232 with which the width of the rafter 102 may be set. Additionally, the main arm 214, the extensions 216, the fascia arm 226, or the soffit arm 228 may also include a linear scale 232 to aid in the adjustment of the template 200. In a more preferred embodiment, any combination of the first arm 204 of the U-shaped component 202, the second arm 206 of the U-shaped component 202, the main arm 214, the extensions 216, the fascia arm 226, or the soffit arm 228 may include a linear scale. Further, the template 200 may include an angular scale 234 on the base 208 of the U-shaped component 202, the fascia arm 226, or the ridge arm 220 to aid in the angular adjustment of these parts of the template 200. More preferably, any combination of the base 208 of the U-shaped component 202, the fascia arm 226, or the ridge arm 220 may include an angular scale 234. The linear and angular scales 232, 234 by be printed, embossed, engraved or produced by a manner suitable to produce a legible scale.

Preferably, the template 200 according to any of the embodiments described above is made of a resilient material capable of holding it shape while in use. Exemplary materials include, but are not limit to, wood, steel, aluminum, plastic, and fiberglass.

Figure 9:
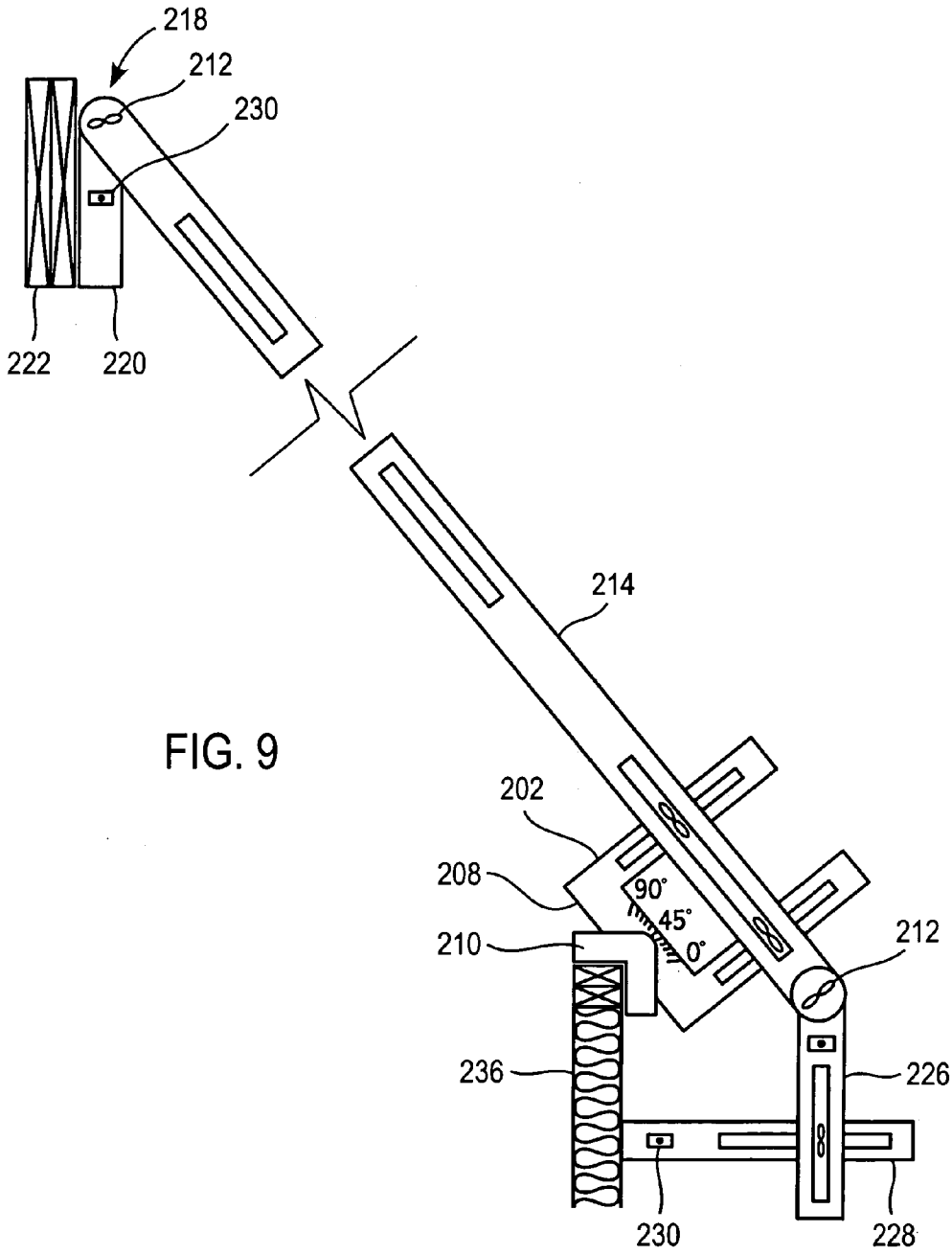
FIG. 9 is a schematic view of a use of a template according to an embodiment of the invention.

A preferred method of use of the template 200 will now be described with the aid of FIG. 9. Preferably, a frame of the structure to be roofed is in place, including the vertical walls 236. Additionally, it is preferable that the common ridge beam 222 of the roof be in place. With the vertical walls 236 and the common ridge beam 222 in place, the seat 210 of the template 200 is placed on the vertical wall 236. Next, the main arm 214 is adjusted for the width of the rafter 102 by sliding the main arm 214 in a direction perpendicular to the base 208 of the U-shaped component 202. Preferably, the width of the rafter 1-2 is set with the assistance of a linear scale 232 on the first 204 or second 206 arms of the U-shaped component 202. Once the width is set, it is preferable to lock the main arm 214 in place by locking the connecting mechanisms 212.

Next, the main arm 214 and any extensions 216 are extended so that the ridge arm 220 is flush against the ridge beam 222. Preferably, the plumb of the ridge beam 222 and the ridge arm 220 may be checked with a level 230 connected to the ridge arm 220. When the ridge arm 220 is plumb and flush with ridge beam 222, connecting mechanisms 212 connecting the ridge arm 220 to the main arm 214 and any extensions 216 may be locked. Preferably, the pitch of the roof may be checked by reading an angular scale 234 on the ridge arm 220.

Next, the fascia arm 226 and the soffit arm 228 may be adjusted by rotating and sliding to provide the desired angle and length of the fascia 106 and soffit 108 of the rafter 102. Preferably, the plumb of the fascia arm 226 and the soffit arm 228 may be checked with levels 230 connected to these arms. Additionally, it is preferable to check the angle of the fascia 106 with an angular scale 234 on the fascia arm 226 and the length of the soffit 108 with linear scales 232 on the fascia and soffit arms 226, 228. When all of the lengths and angles are correct, connecting mechanisms 212, including the connecting mechanism 212 connecting the seat 210 to the base 208 of the U-shaped component 202, may be locked, fixing the angles and dimension of the rafter 102.

When the template 200 is properly adjusted for the desired rafter 102, it may then be taken from the building under construction and transferred to a board 100. The outline of the rafter 102 may be drawn on the board 100 by use of the template 200. The ridge arm 220 delineates the ridge cut 104, the main arm 214 delineates one outer edge of the rafter 102, the fascia arm 226 delineates the tail end or fascia 106, the soffit arm 228 delineates the soffit 108, while the seat 210 delineates the seat or bird's mouth cut 110. Because the various parts 202, 210, 214, 216, 220, 226, 228 of the template are fixed in place, the template 200 may be transferred from board 100 to board 100 to produce additional copies of the desired rafter 102.

The above description of a method of use of the template 200 is by way of illustration only and may be varied. For example, the steps discussed above need not be performed in the order described. The steps may be performed in any order that results in the template 200 accurately producing an outline the desired rafter 102.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

The invention claimed is:

1. A template for measuring a rafter of a roof comprising:
- a U-shaped component including,
  - a first arm with a slot,
  - a second arm with a slot, and
  - a base perpendicular to and connecting the first and second arms;
- an adjustable main arm slidably connected to the first and second arms of the U-shaped component;
- a seat rotatably connected to the base arm of the U-shaped component;
- a ridge arm rotatably connected to a first end of the main arm;
- a fascia arm rotatably connected to a second end of the main arm; and
- a soffit arm slidably connected to the fascia arm.

2. The template of claim 1, wherein the main arm comprises a plurality of extensions.

3. The template of claim 2, wherein the plurality of extensions are slidably adjustable.

4. The template of claim 1, wherein the seat is adapted to rest on a structural wall of a building and to be a template for a bird's mouth cut in the rafter.

5. The template of claim 1, wherein the fascia arm delineates the tail end cut of the rafter.

6. The template of claim 1, wherein the soffit arm delineates the soffit cut of the rafter.

7. The template of claim 1, wherein the ridge arm delineates the ridge cut of the rafter.

8. The template of claim 1, further comprising a level in the ridge arm, the fascia arm, the soffit arm or any combination of arms thereof.

9. The template of claim 1, further comprising locking mechanisms to keep the arms of the template in place.

10. The template of claim 2, further comprising a linear scale on the main arm, the main extensions, the first arm of the U-shaped component, the second arm of the U-shaped component, the fascia arm, the soffit arm, or any combination thereof.

11. The template of claim 1, further comprising an angular scale on the base of the U-shaped component, the fascia arm, the ridge arm or any combination thereof.

12. A method of using a template to make a rafter for a roof comprising:
- providing a template, the template including,
  - a U-shaped component including,
    - a first arm with a slot,
    - a second arm with a slot, and
    - a base arm perpendicular to and connecting the first and second arms;
  - an adjustable main arm slidably connected to the first and second arms of the U-shaped component;
  - a seat rotatably connected to the base arm of the U-shaped component;
  - a ridge arm rotatably connected to a first end of the main arm;

a fascia arm rotatably connected to a second end of the main arm; and a soffit arm slidably connected to the fascia arm;

placing the seat of the template on a wall of the building;

placing the ridge arm of the template against the ridge beam of a structure by adjusting the length of the adjustable main arm of the template;

adjusting the template to establish the width of the rafter by sliding the main arm in the U-shaped component;

setting the tail end of the rafter by adjusting the fascia arm of the template; and setting the soffit of the rafter by adjusting the soffit arm of the template.

13. The method of claim 12, further comprising locking the arms of the template in place.

14. The method of claim 12, further comprising leveling the template by consulting at least one level in the ridge arm, the fascia arm, the soffit arm or any combination of arms thereof.

15. The method of claim 12, further comprising using the seat to determine a bird's mouth cut.

* * * * *